United States Patent [19]

Troseth

[11] 3,940,859

[45] Mar. 2, 1976

[54] UNITARY SPACE TRANSIT

[76] Inventor: Ralph Troseth, 609 Dutchmans Drive, Rogers, Ark. 72756

[22] Filed: Nov. 11, 1974

[21] Appl. No.: 522,349

[52] U.S. Cl. ..... 33/270; 35/44; 58/3

[51] Int. Cl.[2] ..... G04B 49/04

[58] Field of Search ..... 33/268, 269, 270, 271, 33/15 C; 35/43, 44; 58/3

[56] References Cited

UNITED STATES PATENTS

| | | | |
|---|---|---|---|
| 395,058 | 12/1888 | Johnson | 33/268 |
| 1,126,231 | 1/1915 | Kullmer | 35/44 |
| 1,570,349 | 1/1926 | Hollinwood | 33/271 |
| 1,630,891 | 5/1927 | Cooke | 33/271 |
| 2,696,053 | 12/1954 | Royt | 33/270 |
| 3,052,986 | 9/1962 | Merchant | 33/269 |

FOREIGN PATENTS OR APPLICATIONS

| | | | |
|---|---|---|---|
| 1,377,621 | 9/1964 | France | 58/3 |
| 18,568 | 6/1912 | United Kingdom | 33/270 |

*Primary Examiner*—Richard E. Aegerter
*Assistant Examiner*—Steven L. Stephan
*Attorney, Agent, or Firm*—Richards, Harris & Medlock

[57] ABSTRACT

An instrument is provided which requires no complex computations or high degree of skill in aligning scales to accurately indicate the time of day from observations of the position of the sun, and to accurately locate the moon, the sun, and other stars and constellations in celestial space.

The instrument comprises a vertically adjustable stand upon which is mounted a support plane which may be rotated about a horizontal axis to accommodate alignment with the celestial equator. To the support plate is mounted a single rotary disk rotatable about a principal axis normal to the plane of the support plate. Inscribed upon the surface of the disk are an hour scale, a month-day scale, a right ascension hour angle scale, a local hour angle scale, a moon phase scale, a lunation scale to trace the phases of the moon, and a zodiac constellation display.

Integrally formed from and normal to the disk are a sunbeam aperture plate, a sunbeam trace plate, and a plate having a declination scale inscribed thereon and to which a space object pointer with a bubble level is rotatably attached. Inscribed on the surface of the sunbeam trace plate opposite the aperture plate are time equation graphs tracing the movement of the sun in both the northern and southern celestial hemispheres. Sun declination scales and mean sun base lines corresponding to each time graph are also inscribed on the trace plate.

When the support plate is aligned with its face toward the north and parallel to the plane of the celestial equator, the rotary disk may be turned to a position where sunlight passes through an aperture of the sunbeam aperture plate to strike a time equation graph or a mean sun base line inscribed on the trace plate. A rotary meridian marker mounted to the support plate so as to rotate about its principal axis independent of the rotary disk may then be used to directly indicate standard time, daylight saving time, solar time, or mean solar time on the hour scale.

To function as a space transit, the rotary disk may be adjusted for longitudinal correction and right ascension, and the space object pointer may be adjusted for declination to locate the moon, sun, planets and other stars and constellations in space. Conversely, after the instrument has been directed toward an object in space, the instrument may be adjusted to indicate the right ascension and declination of the object. In addition, the constellations of the zodiac may be more generally located by means of the zodiac constellation display and a knowledge of the sun's declination during the month of concern.

The moon phase and lunation interval scales make possible the tracing of any moon phase throughout the current and subsequent years. Further, when the date of the moon phase is determined, the right ascension and hour angle of the moon at any given time during the phase may be acquired.

12 Claims, 5 Drawing Figures

UNITARY SPACE TRANSIT

FIELD OF THE INVENTION

The present invention relates generally to the field of astronomy, and more particularly to devices for indicating the correct time of day and for locating at any time the position in space of the sun, the moon, and specified stars or constellations.

PRIOR ART

Sundials have long been in use for indicating the time of day by the position of a shadow cast by the sun on a graduated plate or surface. Improvements to the basic sundial such as that disclosed in the Applicant's U.S. Pat. No. 3,417,473 provide means by which standard time may be accurately determined by direct readings from the sundial throughout the year.

U.S. Pat. Nos. 1,570,349 and 1,630,891; British Patent No. 214,034 and French Pat. No. 915,671 each disclose intruments for indicating the time of day. British Patent No. 214,034; U.S. Pat. No. 1,570,349; and U.S. Pat. No. 1,630,891 more particularly disclose an instrument including a base plate upon which a rotary disk having a rotational axis aligned with the Earth's rotational axis is mounted, and two parallel plates extending perpendicularly from the face of the disk and fixedly secured thereto. One of the plates is apertured so that a sun ray passing through the aperture will appear as a light spot on the inner face of the second plate. When the sun image is bisected by a center line on the second plate, apparent local or sun time may be directly read. British Patent No. 214,034 and U.S. Pat. No. 1,630,891 further disclose the placement of a graph describing the annual path of the center of the sun image upon the inner face of the second plate. When the disk is rotated until the center of a sun image passing through the apertured plate falls on an edge of the graph, a time pointer indicates true standard time.

French Pat. No. 915,617 includes a sunbeam apertured plate and a sunbeam trace shelf operating in combination with means for adjusting a time indicator to provide readings for daylight saving time, standard time, and for different time zones.

The amateur astronomer's interest in space has transcended the mere telling of time. However, before the development of various instruments to assist the amateur astronomer, the location of celestial bodies in space was made by either referring to periodically published sky maps or by referring to tables such as those published in "The Ephemeris," which is published annually by the Nautical Almanac Office of the United State Naval Observatory. As the use of the tables and sky maps in combination with the telescope requires a fair degree of technical knowledge and computational ability, such materials were useful to only a small percentage of the general public.

U.S. Pat. Nos. 2,231,071 and 3,052,986 disclose instruments for locating any designated star or constellation in celestial space. U.S. Pat. NO. 2,231,071 specifically discloses an instrument which locates a star or constellation and includes means for providing a correction for the date to reduce local mean time to sidereal time, means for rotating a sighting device about one axis to align a marker with the correct right ascension indication, and means for rotating the sighting device about a second axis perpendicular to the first to align a second marker with a declination indication. It is noted, however, that there is provided no correction for a viewer's longitude to reduce standard time to local mean time. Further, the disclosed instrument has no means for directly indicating the time of day.

U.S. Pat. No. 3,052,986 discloses an instrument for not only locating a selected star or constellation in the celestial sphere, but also for directly indicating either a local sun time or a standard time. The instrument comprises a space object alignment unit including three contiguous disks rotating about a principal axis, with a first disk having an hour circle and a longitude scale, a second disk having a month-day and a right ascension scale, and a third disk having a right ascension index pointer. Each of the three disks may rotate independently about a principal axis of rotation. A plate extends perpendicularly from the surface of the three disks and is mounted so as to rotate with the right ascension index pointer disk. The plate includes a semicircular declination scale inscribed on one surface and a declination pointer rotatably mounted so as to rotate about an axis perpendicular to the principal axis of rotation.

Neither U.S. Pat. No. 2,231,071 nor U.S. Pat. No. 3,052,986 include a sunbeam aperture shelf or a sunbeam trace shelf, nor do either employ a time equation graph.

The present invention provides an improved astronomical instrument which may be accurately aligned with both true North and the Earth's rotational axis without requiring the use of a magnetic compass or previous knowledge of the observer's latitude. The instrument may be directed toward any object in space when the right ascension and declination of the object are known, and conversely may be adjusted from a line-of-sight alignment to indicate the right ascension and declination of an unknown space object. In addition, a simplified means is provided to accommodate conversion from standard to mean solar and solar time. Further, as all scales are contained on a single rotary disk, an astronomical instrument is provided which is more compatible with amateur usage, and which requires a lesser level of technical skill and computational ability.

SUMMARY OF THE INVENTION

The present invention is directed to an astronomical instrument with which an observer using minimal skill and having only basic datum may accurately determine the time of day and the position of space objects relative to the observer's position.

More particularly, an hour scale, a month-day scale, a right ascension hour angle scale, a local hour angle scale, a moon phase scale, a lunation scale, and a zodiac constellation display are concentrically inscribed about a principal axis of rotation on a single rotary disk. Integrally formed from and normal to the rotary disk is a plate having a declination scale inscribed thereon, a sunbeam aperture plate, and a sunbeam trace plate upon which are inscribed time equation graphs, mean sun base lines and sun declination scales. Contiguous to the rotary disk is a meridian marker rotatably about the principal axis of rotation. In addition, a declination position indicator is mounted adjacent to the declination scale so as to rotate about a declination axis normal to the principal axis of rotation. Attached to the declination position indicator and positioned on the opposite side of the declination plate is a space object pointer.

The rotary disk so inscribed, the rotary meridian marker, the declination position indicator, and the space object pointer may be operated in combination to accurately locate celestial objects in space from a knowledge of only the observer's longitude and the celestial object's right ascension and declination. As all scales and graphs are inscribed on a single rotary disk, complex computations and the relative alignment of scales are not required. More specifically, the space object pointer may be used to direct the instrument toward true North or true South, to determine the latitude of the observer's position from observations of the sun, and to align the rotary disk with the equatorial plane of the celestial sphere. The rotary meridian marker then may be adjusted for a longitude correction and the rotary disk adjusted for a right ascension indication. When the declination position indicator is rotated to the declination of the celestial object, the object appears within the field of view of the space object pointer. In addition, by a reverse process, the instrument may be directed toward an unknown celestial object, and then adjusted to indicate the right ascension and declination of the object.

Further, after the rotary disk has been directed toward true North or true South and aligned with its principal axis parallel to the axis of rotation of the Earth, the moon phase and lunation scales may be used in combination with the month-day, hour, and right ascension hour angle scales to trace the phases of the moon during a year of observation in which the date of a single moon phase is known, and to accurately determine the right ascension and hour angle of the moon at any time during a particular moon phase.

Alternatively, the instrument may be used as an accurate sundial by turning the rotary disk until sunlight passes through an aperture of the sunbeam aperture plate and strikes a time equation graph or a mean sun base line. The rotary meridian marker may be used in combination with a time equation graph or analemma to indicate mean solar time on the hour scale, or in combination with a mean sun base line to indicate solar time on the hour scale. In addition, the rotary marker may be adjusted for a longitude correction and the rotary disk turned until a sun spot image is bisected by a time equation graph to provide a direct reading of standard time on the hour scale.

In one aspect of the invention, there is provided a space object pointer having a bubble level to facilitate latitude adjustments to the rotary disk, the plumbing of the instrument, the determination of the observer's zenith and horizon, the taking of azimuth and elevation readings, and the determination of space object rising and setting times relative to the observer's horizon.

In another aspect of the invention, the space object pointer includes sunbeam aperture and trace shelves for observing the azimuth and elevation of the sun and for determining the direction of true North and true South.

In still another aspect of the invention, the rotary disk comprises a sunbeam trace plate having both a northern hemisphere time equation graph and a southern hemisphere time equation graph inscribed thereon, and a sunbeam aperture plate having two apertures each aligned with one of the two graphs to provide a more compact instrument.

In still another aspect of the invention, the rotary marker has mounted thereon a lunation blade rotatable about an axis offset from the principal axis of rotation to facilitate tracking of the phases of the moon.

DESCRIPTION OF THE DRAWINGS

For a more complete understanding of the present invention and for further objects and advantages thereof, reference may now be had to the following description taken in conjunction with the accompanying drawings in which.

DESCRIPTION OF PREFERRED EMBODIMENTS

FIGS. 1–3

Figure 1:
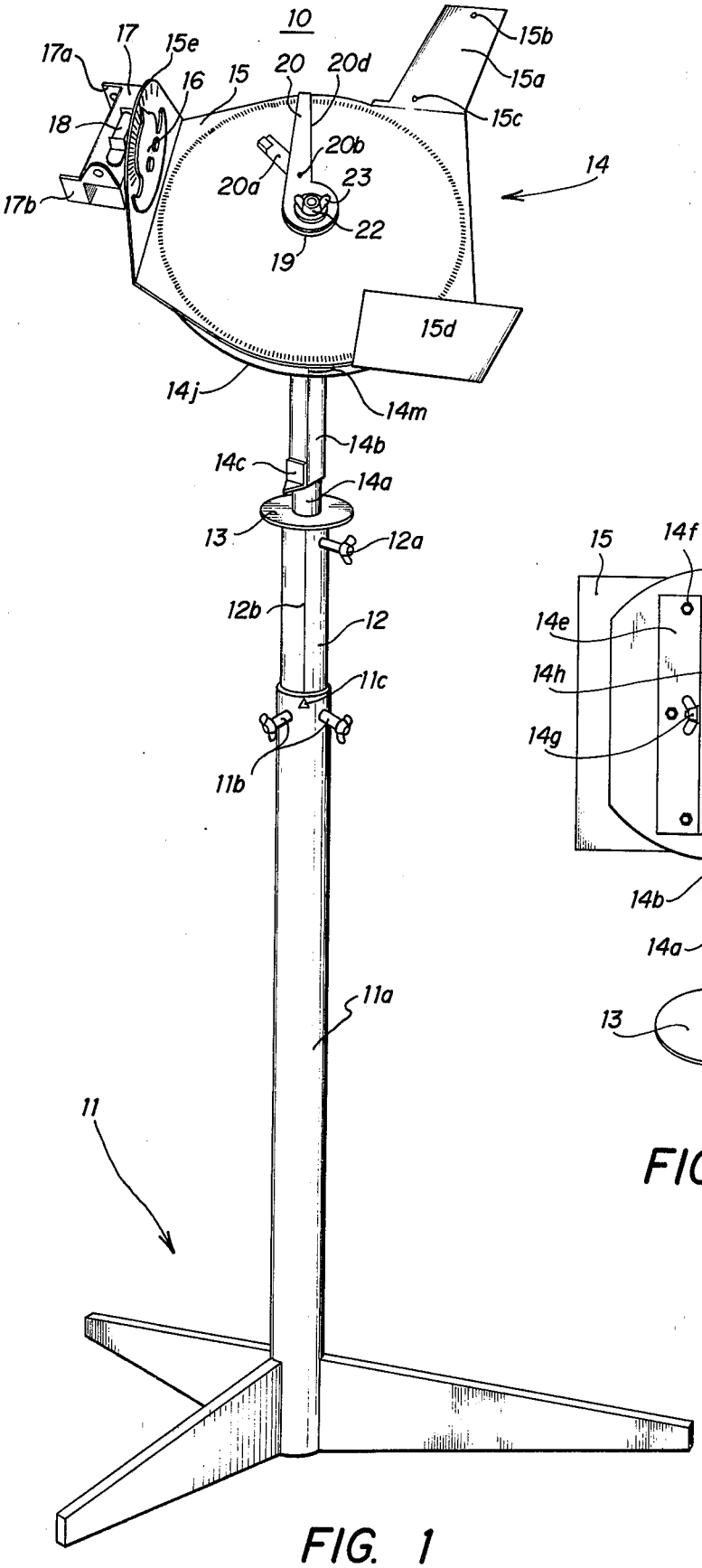
FIG. 1 is a perspective view of space transit embodying the present invention.
Figure 2:
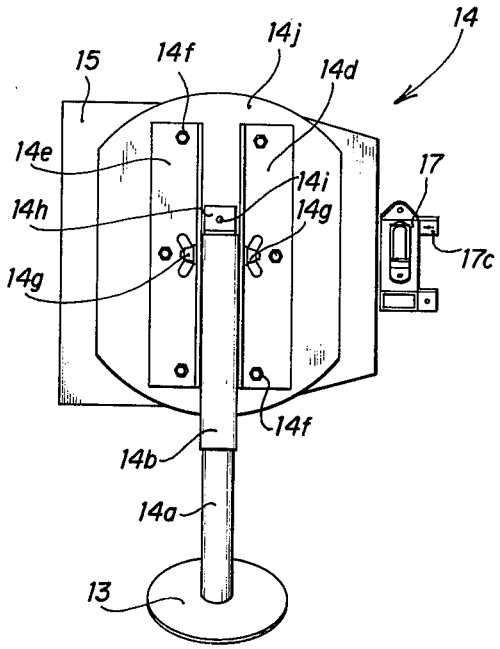
FIG. 2 is a plan view from the rear of the space transit of FIG. 1 with the plane of the rotary disk vertically aligned.
Figure 3:
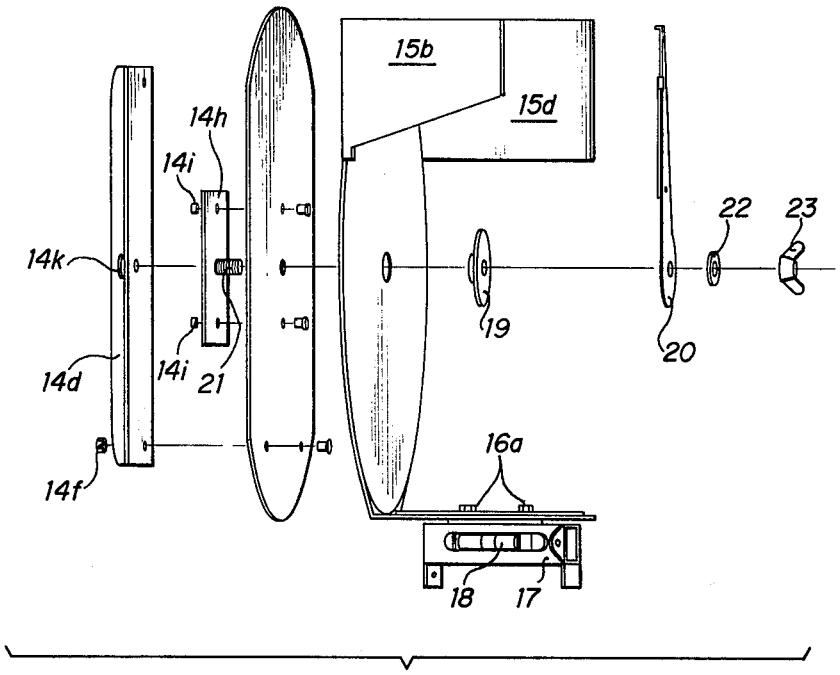
FIG. 3 is a partially exploded view from the side of the space transit of FIG. 1.

Referring to FIGS. 1–3, there is illustrated a space transit 10 comprising a tripod stand 11, a hollow extension rod 12 subtended at one end by an annular flange 13, and a transit head 14.

Extension rod 12 is rotatably and slidably received within a vertical tube **11*a* of stand 11, and held in place by two friction screws 11*b***.

A cylindrical support post **14*a* of transit head 14 is rotatably and slidably received within extension rod 12 and held in place by a friction screw 12*a*. A triangular marker 11*c* etched on the outer surface of tube 11*a*, and a longitudinal line 12*b* etched on the outer surface of rod 12 may be used in combination to maintain a proper rotary alignment when rod 12 and post 14*a*** are extended for greater height.

Encircling post **14*a* at an upper end is a rectangular sleeve 14*b*. At the lower extremity of sleeve 14*b* is mounted a triangular marker 14*c* which extends transversely from the principal axis of the sleeve. The lower surface of marker 14*c* confronts the upper surface of flange 13 when post 14*a*** is in a recessed position.

A support plate **14*j* is rotatably mounted upon post 14*a* so as to rotate about a horizontal axis. Mounted upon plate 14*j* is a rotary disk 15, which may be rotated about a threaded post 21 coincident with both the principal axis of plate 14*j* and the principal axis of rotation of disk 15. Disk 15 includes a sunbeam aperture plate 15*a* having apertures 15*b* and 15*c*, a sunbeam trace plate 15*d* parallel to plate 15*a*, and a declination position plate 15*e* having its plane perpendicular to the planes of plates 15*a* and 15*d*. Plates 15*a* and 15*d* are offset from the center of disk 15, and extend perpendicularly from the plane of disk 15. Plate 15*e* is offset from the center of disk 15 in a direction opposite to that of plates 15*a* and 15*d*, and also extends perpendicularly from the plane of disk 15. Each of the plates 15*a*, 15*d* and 15*e* are integrally formed extensions of disk 15 which have been folded to a position perpendicular to the principal plane of disk 15**.

Inscribed upon the face of disk 15 are scales concentric to the principal axis of rotation of disk 15 which are used in indicating time and locating space objects as will be described below. The terms used throughout the description of the preferred embodiment conform to standard usage in the field of astronomy. Specific references include *Astronomy* by Robert H. Baker, Third Edition, D. Van Nostrand Company, Inc. and *Fundamentals of Celestial Mechanics* by J. M. Danby, First Edition, Yale University.

A declination position indicator 16 is adjacent to the interior face of plate 15*e*, and secured by means of bolt and nut combinations 16*a* to a space object pointer 17 adjacent to the outer face of plate 15*e*. Indicator 16 and pointer 17 are mounted so as to rotate about an axis perpendicular to the disk 15 principal axis of rotation.

Space object pointer 17 comprises an open ended and hollow rectangular box with a principal axis parallel to the plane of plate 15*e*. A sun aperture shelf 17*a* and a sun trace shelf 17*b* are integrally formed from an exterior face of shelf 17 parallel to plate 15*e*. A bubble level 18, which is a cylindrical vial having an internal barrel shape to accommodate 360° rotation, is mounted along the principal axis of pointer 17 on an exterior face having a principal axis parallel to the plane of plate 15*e*.

A rotary meridian marker 20 used in conjunction with the scales inscribed on disk 15 is rotatably mounted to plate 14*j*. More particularly, a threaded washer 19 is screwed into a threaded post 21, and interposed between disk 15 and marker 20. Post 21 in turn is secured to a plate 14*h* which is fixedly mounted to the rear face of plate 14*j* by means of brad and sleeve combinations 14*i*.

Marker 20 is secured in place by means of a washer 22 and a threaded cap 23, and so mounted as to be able to either rotate about the principal axis of rotation or be fixed in place independent of the rotation of disk 15. A downward bent tip 20*c* of marker 20 rides on the outer rim of disk 15 to protect the face of the disk from defacement. Affixed to the underside of marker 20 by means of a brad 20*b* is a lunation blade 20*a* which is used to trace the phases of the moon during a year of observation.

The mounting of plate 14*j* to vertical post 14*a* may better be seen by referring to FIG. 2, wherein flanges 14*d* and 14*e* are shown secured to the underside of plate 14*j* by means of nut and bolt combinations 14*f*. Sleeve 14*b* is slidably received between flange walls extending perpendicularly from the underside of plate 14*j*, and fixedly held with respect to support post 14*a* by means of a threaded shaft 14*k* generally indicated by dotted lines in FIG. 2. Shaft 14*k* extends through the outwardly extending flange walls, sleeve 14*b* and post 14*a*, and is secured in place by means of washers 14*r* and threaded caps 14*g*. Plate 14*j* thus is mounted so as to be rotatable about a horizontal axis transverse to sleeve 14*b* and coincident with shaft 14*k*.

FIG. 4

Figure 4:
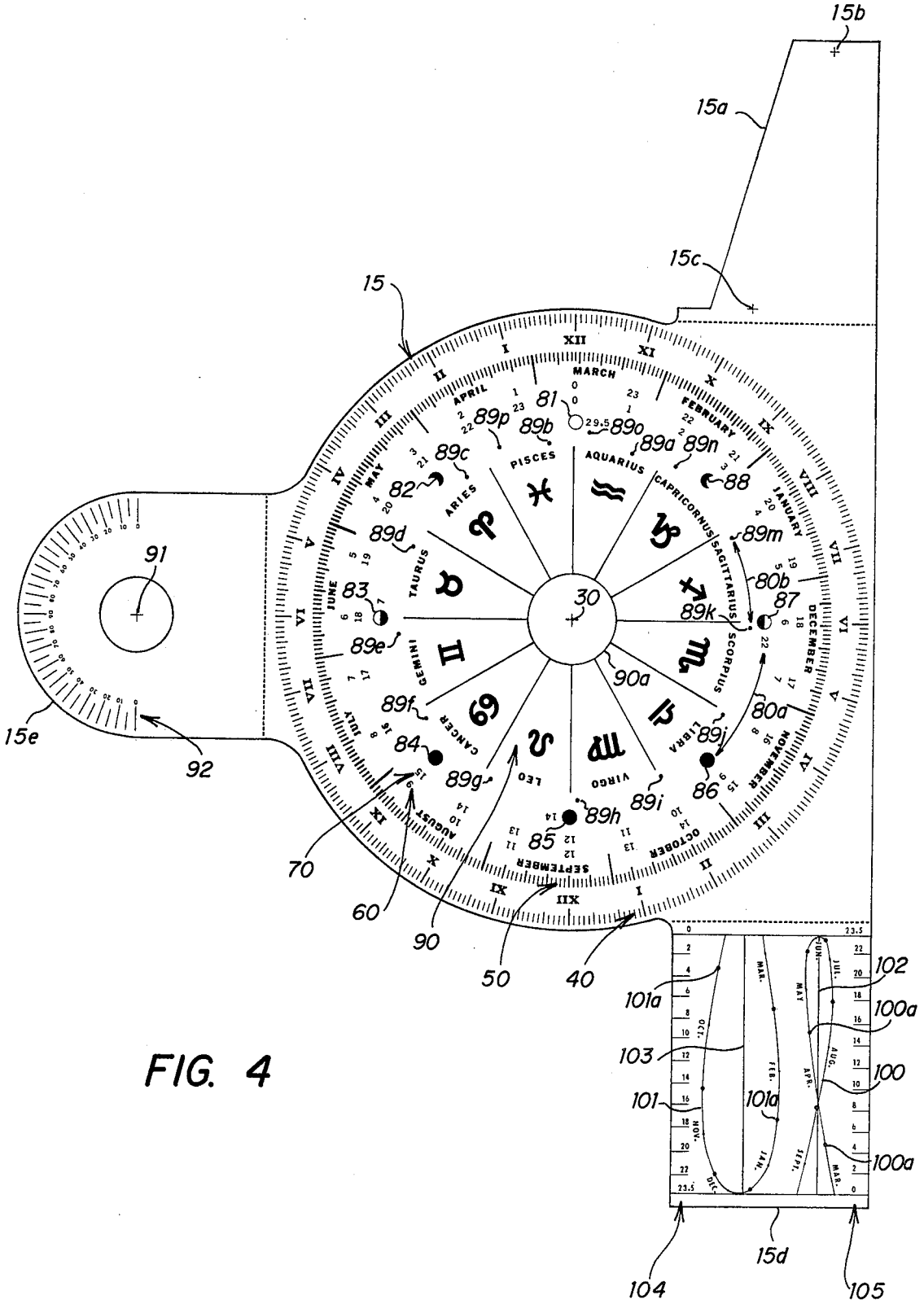
FIG. 4 is a pictorial view of the rotary disk of FIG. 1 with integral plates aligned with the plane of the disk.

A more detailed illustration of the scales inscribed upon the face of rotary disk 15 is shown in FIG. 4, wherein numerous scales are concentrically arranged about the principal axis of rotation, which passes through a mounting aperture 30 perpendicular to the plate. Ordered from the outermost scale toward the aperture 30 are a sun time or hour scale 40, a month-day scale 50, a right ascension hour angle scale 60, a local hour angle scale 70, a moon phase scale 80*a*, a lunation interval scale 80*b*, and a zodiac constellation display 90.

Hour scale 40 is formed by marking disk 15 with 24 equal divisions about the circumference of an outer circle centered at aperture 30. The divisions of the scale are designated by Roman numerals beginning with numeral I and increasing counterclockwise to numeral XII, and then repeating in sequence with a second numeral XII, 12:00 Noon, aligned with the vernal equinox or March 21 division mark of the month-day scale 50. The Roman numeral divisions are in turn separated by 15 lesser extended division marks corresponding to 1° intervals. The accuracy of scale 40 is transferred to the inner scales by way of radial edge 20*d* of meridian marker 20, FIG. 1.

The month-day scale 50 is formed by dividing a circle on disk 15 into segments equal to the number of days in each month in a normal leap year. Slightly extended marks are used to indicate five day intervals, while more extended marks are used to indicate the end of a month. The distances between the marks are proportioned according to the numbers of days in each month. The calendar months are placed from January to December in a counterclockwise direction and positioned so that the scale location corresponding to March 21 is located along the radial line from the aperture 30 to the Roman numeral XII of scale 40 corresponding to 12:00 Noon.

Right ascension hour angle scale 60 consists of division marks dividing a circle into 24 equal hour segments. The segments are numbered from 1 through 23 in a counterclockwise direction, with the 24th division mark being identified as a "O" positioned radially below the March 21 division mark on month-day scale 50 and corresponding to the right ascension angle of the vernal equinox.

The local hour angle scale 70 consists of 24 divisions radially aligned with the division marks for the right ascension hour angle scale 60, and positioned about the circumference of a circle nearer to aperture 30. The identifying numbers 0 through 23 of the local hour angle scale, however, increase in a clockwise rather than a counterclockwise direction with the number 1 being located radially below the number 23 of scale 60.

The moon phase scale 80*a* contains in a counterclockwise direction about aperture 30 a new moon symbol 81, a first crescent phase symbol 82, a first quarter symbol 83, a first gibbous phase symbol 84, a full moon symbol 85, a second gibbous phase symbol 86, a third quarter symbol 87, and a second crescent phase symbol 88. The moon phase scale is formed by placing the new moon symbol 81 on a radial line from the aperture 30 to the zero hour angle indication on the right ascension hour angle scale 60, and then dividing the circumference of the circle passing through the new moon symbol into eight equal segments. Symbols 82 through 88 are then placed in sequence in a counterclockwise direction from symbol 81 on radial lines extending from the aperture 30 to the one-eighth divisions of the circumference of the moon phase scale 80*a*.

To understand the positions in which to expect the moon at any time it is most convenient to consider its position relative to the sun. For example, when the moon is new it is in the same direction as the sun. Consequently, it rises and sets with the sun, and cannot be seen from the Earth. As the Earth moves in its orbit about the sun, the moon orbits about the Earth and it is not until after the lapse of approximately 29.5 days that the moon is in the same position relative to the sun's direction. The 29.5 days is referred to as the synodic month.

The days of the synodic month during which a particular phase may occur are indicated on the moon phase scale 80*a*. For example, the number 7 adjacent to the first quarter symbol 83 indicates that a first quarter phase occurs seven days after the new moon phase. Similarly, a number 14 is adjacent to full moon symbol 85, a number 22 is adjacent to the third quarter symbol 87 and a number 29.5 is adjacent to the new moon symbol 81. Thus, it is indicated that a full moon occurs 14 days after the new moon phase, a third quarter moon phase occurs 22 days after the new moon phase, and a new moon occurs once each 29.5 days corresonding to the synodic month.

A lunation interval scale 80*b* is inscribed as a sequence of lunation dots, 89*a*–89*k* and 89*m*–89*p*, on disk 15 to indicate the interval between similar phases of the moon during the course of a year. If a new moon were to occur on a particular year around February 28 corresponding to the location of lunation dot 89*a*, the dates for new moons during that year would be February 28, March 30, April 28, May 28, June 26, July 26, August 24, September 23, October 22, November 21, December 20, January 19, and February 17 of the following year.

The lunation interval scale 80*b* is made by inscribing a first dot, for example dot 89*a*, at a convenient location on the scale and then inscribing 12 subsequent dots, 89*b*–89*k* and 89*m*–89*n*, in a counterclockwise direction at intervals corresonding to the lunation period or synodic month. As the lunation period is approximately 29.5 days, the approximate angular separation between adjacent dots on the scale is equal to $[(360 \div 365.25) \times 29.5]$ degrees where 365.25 is the approximate number of days for the Earth to complete one orbit around the sun.

As the particular phases of the moon are seen to occur on different days as one proceeds from year to year, an additional aid is required to maintain a 29.5 day period as a year-to-year trace of a particular moon phase is made. Lunation dots 89*o* and 89*p* used in combination with lunation blade 20*a*, FIG. 1, perform this function as will be later explained. As may be seen by inspection of FIG. 4, dot 89*o* is displaced 29.5 days counterclockwise from dot 89*n*, and dot 89*p* is displaced 29.5 days counterclockwise from dot 89*o* to continue the 29.5 day period as one proceeds from year to year.

To generally locate constellations in space, a zodiac constellation display 90 is formed about a circular hub 90*a* centered at the aperture 30. Radial spokes extending outward from the hub divide the map into 12 equal segments, each 30° in width and having placed therein the astronomical name and symbol of a constellation. The display thus may be used as a constellation position indicator generally locating a constellation relative to the celestial equator.

Inscribed on the inner face of plate 15*e* is a semicircular declination angle scale 92 having division marks formed on the circumference of a circle concentric to a mounting aperture 91. The division marks of scale 92 are separated by five degree intervals located on radial lines extending outward from aperture 91. Slightly extended division marks spaced 10 degrees apart are numbered in sequence beginning with the number 0 at one end point of the semicircular scale and ending with the number 90 at the apex of the scale. The extended division mark numbers then decrease in sequence from the number 90 to the number 0 at an opposite end point of the scale.

Diametrically opposite to plate 15*e* on disk 15 are plates 15*a* and 15*d*. Sunbeam aperture plate 15*a* comprises apertures 15*b* and 15*c* which focus a sun image on a time equation graph or analemma inscribed on the inner surface of sunbeam trace plate 15*d*. A mean sun base line 102 dissects analemma part 100, while sun base line 103 dissects analemma part 101. The analemma parts 100 and 101 are further divided into month segments, with each segment corresponding to a particular month identified by an abbreviation. Each month segment is defined by two consecutive end of the month dots, generally indicated by reference numbers 100*a* and 101*a* on analemma parts 100 and 101, respectively. Analemma part 101 and mean sun base line 103 are used to trace the movement of the sun in the southern celestial hemisphere, while analemma part 100 and means sun base line 102 trace the movement of the sun in the northern celestial hemisphere.

The information necessary to prepare a tme equation graph or analemma, such as that shown by analemma parts 100 and 101, may be obtained from a publication which shows the equation of time for the sun. "The Ephemeris", prepared each year by the Nautical Almanac Office of the United States Naval Observatory and published by the United States Government Printing Office, provides information from which may be prepared time equation graphs accuarate to a fraction of a minute.

The declination of the sun at any observation date may be obtained from the analemma parts 100 and 101 when used in combination with adjacent declination scales. To the left of analemma part 101 and parallel to base line 103 is a sun declination scale 104 which is graduated to indicate degrees of south declination. Correspondingly, to the right of analemma part 100 and parallel to base line 102 is a sun declination scale 105 which is graduated to indicate degrees of north declination.

While the space transit herein described is designed for operation in the northern hemisphere, it is to be understood that operation in the southern hemisphere may be accommodated by adjusting the inscriptions on disk 15 to permit the instrument to be operated while pointed to true South instead of true North.

In accordance with the invention, there is provided a space transit 10 which will point to any address in space when the instrument is properly adjusted for longitude correction, declination, and right ascension. Conversely, when the instrument is directed toward an object in space, the right ascension and declination of the object may be read directly from the instrument. The invention further provides an instrument with which the lunations and positions of the moon phases may be determined. In addition, a simple sundial is provided from which solar, mean solar, standard or daylight saving time can be read directly.

In operation as a sundial, the principal axis of rotation of disk 15 is placed in a horizontal plane by rotating late 14*j* about shaft 14*k*. More particularly, the declination position indicator 16 is rotated to indicate zero degrees declination on scale 92, and the bubble level 18 is used to place the principal axis of plate 14*j* in a horizontal plane. Disk 15 is then rotated about threaded post 21 until Roman numeral XII of scale 40, radially below September 19 on month-day scale 50, is positioned above a radial mark 14*m* inscribed on plate 14*j*. Transit head 14 is then rotated about a vertical axis coincident with support post 14*a*, and space object pointer 17 is rotated about a horizontal axis normal to plate 15*e* until a sun ray is transmitted through the apertured shelf 17*a* and intersects a transverse midline 17*c* on the trace shelf 17*b*. The position of the triangular marker 14*c* is then noted on the annular flange 13 of extension rod 12. One of two procedures may then be followed:

a. The position of the declination position indicator 16 may be maintained and the sun traced until a sun spot image again intersects the midline on trace shelf 17*b*. During this process only transit head 14 is rotated about the vertical axis. No other motion takes place. When the correct sun image is acquired, the second position of the triangular marker 14*c* is noted on flange 13. Transit head 14 is then rotated about the vertical axis until the triangular marker is positioned at a midpoint between the two previous noted positions. The principal axis of plate 14*j* is then pointed due North.

b. Alternatively, both the declination position indicator 16 and the transit head 14 may be rotated to plot or trace the sun path during the day. The triangular marker 14*c* will then be positioned at the zenith of the plot along the horizontal flange 13 to align the space transit 10 with true North.

A correction for the observer's latitude is next made. Assuming the sun is in the northern celestial hemishere, the declination of the sun for a given day of observation may be obtained for analemma part 100 used in combination with declination scale 105. Further, the high noon elevation of the sun may be determined from scale 92 when used in combination with shelves 17*a* and 17*b* of space object pointer 17 as before described. The sun's declination is subtracted from the high noon elevation, and indicator 16 is adjusted to indicate the complement, the angle between the observer's zenith and the celestial equator.

Plate 14*j* then may be rotated about shaft 14*k* until the bubble level 18 indicates a horizontal position. The plane of rotary disk 15 thereby is placed in the celestial equator, and the principal axis of plate 14*j* is aligned with the rotational axis of the Earth.

To obtain a direct reading of the time of day, the meridian marker 20 is aligned vertically with the vernal equinox, March 21 on month-day scale 50, and fixed in place by tightening cap 23. This setting is aligned with Roman numeral XII corresponding to 12:00 Noon on the hour scale 40 and with the new moon symbol 81 on the moon phase scale 80*a*. With marker 20 thus set, disk 15 is rotated about post 21 relative to the marker. Such rotation continues until a sunbeam image passes through the sunbeam aperture plate 15*a*, and either strikes a time equation graph or a mean sun base line on the sunbeam trace plate 15*d* at a position corresponding to the date of observation. If the sun image is bisected by either mean sun base line 102 or 103, then solar time may be read on hour scale 40 as indicated by marker 20. However, if the sun image is bisected by analemma parts 100 or 101, then mean solar time may be read from hour scale 40.

To directly read standard time from the space transit, a longitudinal correction must be made which corresponds to the longitude of the observer. More particularly, if the position of the observer is offset to the East of the center of the observer's time zone, disk 15 is rotated relative to marker 14*m* on plate 14*j* in a clockwise direction the number of degrees of the offset as indicated on hour scale 40, and alternatively in a counterclockwise direction if the observer's position is West of the time zone center. The meridian marker 20 is then realigned with the Roman numeral XII of scale 40 corresponding to the new moon symbol 81 of moon phase scale 80*a*, and disk 15 is rotated with respect to marker 20 until a sun image strikes a time equation graph on trace plate 15*d* at a position corresponding to the date of observation. With space transit 10 aligned as above described, standard time may be read from the hour scale 40 as indicated by marker 20.

In addition to indicating time of day, the instrument may be used to take azimuth and elevation readings, and to establish the zenith and horizon of the observer. More particularly, the declination position indicator 16 is rotated to indicate zero degrees declination on scale 92, and the bubble level 18 is used to place the principal axis of plate 14*j* in a horizontal plane. When the space transit 10 is raised to eye level, the space object pointer 17 will be in line with the observer's horizon. Further, when the declination position indicator 16 is rotated to indicate ninety degrees declination on scale 92, the space object pointer 17 will be directed toward the observer's zenith.

For azimuth and elevation readings, indicator 16 is rotated to indicate 90° on scale 92, and the bubble level 18 is used to place the principal axis of plate 14*j* in a vertical plane. An azimuth reading then may be taken by rotating plate 15 about post 21 and sighting with pointer 17. The angular movement between hour scale 40 and radial mark 14*m* then becomes a measure of azimuth in degrees. In addition, the angular distance between indicator 16 and the ninety degree division mark on scale 92 becomes a measure of elevation.

Space transit 10 also may be used to indicate the position of a star or other space object when the right ascension and declination of the object are known. First, a longitudinal correction is made by rotating disk 15 relative to mark 14*m* on plate 14*j* as before described, and the rotatable marker 20 is aligned with the Roman numeral XII on scale 40 corresponding to the new moon symbol 81 on the moon phase scale 80*a*. The meridian marker 20 then is fixed in place by tightening cap 23, and disk 15 is rotated about post 21 until the date of observation as noted on the month-day scale 50 is aligned with marker 20. The March 21 division mark on the month-day scale 50 then points outward to the position of the vernal equinox at 12:00 Noon on the date of observation.

With disk 15 and marker 20 aligned as above described, marker 20 may be rotated from the March 21 division a distance equivalent to the right ascension of the object as indicated by the right ascension hour angle scale 60 and locked in place, and the declination position indicator 16 may be rotated to the declination of the object as indicated by declination scale 92. The image of the object then will be located within the field of view encompassed by space object pointer 17 at the time indicated by marker 20 on hour scale 40.

In summary, a longitudinal correction is made and disk 15 rotated to the date of observation as indicated by marker 20. The position of the vernal equinox at noon at the day of observation is then shown by the March 21 division mark on the month-day scale 50. The marker 20 is then rotated from the March 21 division mark a distance corresponding to the right ascension of the space object being sought. With the declination position indicator 16 adjusted to indicate the declination of the object, disk 15 may be rotated with respect to marker 20 to align pointer 17 with the object at any time of day as indicated by the marker on hour scale 40. Further, the rising and setting times for the space object may be determined by rotating disk 15 until pointer 17 is aligned with the observer's horizon as determined by bubble level 18.

If a star or other space object unknown to the user is sighted, the right ascension and declination of the object may be determined for identification. First, a longitudinal correction is made as above described and disk 15 is rotated to the date of observation as indicated by marker 20. The marker 20 then is rotated to the hour of observation as noted on the local hour angle scale 70 and fixed in place to point to the position of the vernal equinox at the time of observation. The image of the space object is positioned within the field of view enclosed by space pointer 17 by rotating the disk 15 about threaded post 21, and rotating the space object pointer 17 about the declination axis of rotation normal to plate 15*e*. The declination of the space object then is indicated on scale 92 by the position indicator 16, and the right ascension of the object is indicated on scale 70 by marker 20.

In determining the location and phase of the moon at any time of observation, moon phase scale 80*a* and lunation interval scale 80*b* are used. The lunation interval scale 80*b* indicates the interval between similar phases of the moon during the course of the year. The intervals shown by the scale may be read in approximate days on the month-day scale 50. An observer uses the lunation scale as shown in the illustrative embodiment by noting at one time during the year the number of days separating a particular phase of the moon and one of the lunation dots 89*a*–89*k* and 89*m*–89*p*. For example, in a year of observation a full moon may occur on March 5 or five days after the scale position of lunation dot 89*a*. The dates of each full moon throughout the year then may be determined as the full moons will occur five days after each of the dots 89*b*–89*k* throughout the year of observation. The full moon phases may also be traced into the succeeding year by noting the synodic month or 29.5 day separation between lunation dots 89*m*–89*p*. However, after lunation dot 89*p*, there is no succeeding dot spaced a 29.5 day interval. Thus, an additional aid is required to trace the moon phases into a succeeding year.

FIG. 5

Figure 5:
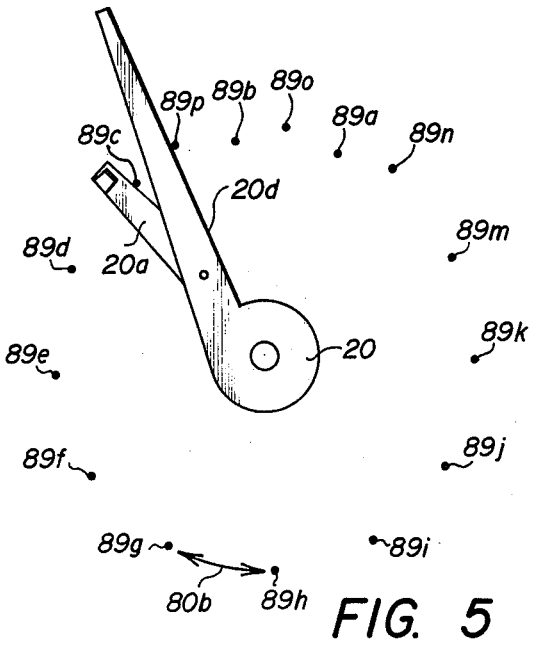
FIG. 5 is a pictorial view of the rotary marker of FIGS. 1 and 3 with a lunation blade extended to be in operable relation with the lunation scale of FIG. 4.

In accordance with one aspect of the invention as illustrated in FIG. 5, lunation blade 20*a* and rotary marker 20 are used in combination with lunation scale 80*b* to trace the phases of the moon from a year of observation to a succeeding year. More particularly, lunation blade 20*a* may be rotated about brad 20*b* to place the inner edge of the blade in coincidence with a succeeding lunation dot. For example, with edge 20*d* of marker 20 coincident with lunation dot 89*p*, lunation blade 20*a* may be extended to place the inner edge of the blade in coincidence with lunation dot 89*c*. Thus, the synodic intervals may be continued with blade 20*a* while the moon phase occurrences continue to be indicated by marker 20.

Further, if marker 20 is initially aligned with a moon phase date on scale 50 which occurs between lunation dots, blade 20a may be extended to an adjacent lunation dot to maintain a synodic interval. The dates of moon phase occurrences, however, are indicated by marker 20 as before.

After an observer has determined the dates corresponding to a single phase of the moon for a particular year of observation, he can determine the dates of all phases of the moon during the year by reference to the moon phase scale 80*a*. For example, if a fully moon occurs on March 5 of a particular year, then by reference to moon phase scale 80*a* it can be determined that the third quarter phase as represented by symbol 87 will occur eight days after the full moon phase as represented by symbol 85. Thus, the third quarter phase of the moon will occur on March 13 of the year of observation.

In accordance with the invention, there is provided a space transit for accurately indicating the time of day and locating objects in space, with all scales, maps, and graphs necessary for its use inscribed on a single rotary disk.

The invention further provides a rotary meridian marker mounted about the principal axis of rotation of the rotary disk, and having a lunation blade to be used in combination with a lunation interval scale and a moon phase scale to trace the phases of the moon through a year of observation and into a succeeding year.

There is still further provided a space object pointer having a bubble level, a sunbeam aperture shelf and a sunbeam trace shelf for accurately aligning the instrument toward true North, toward true South, and in the plane of the celestial equator. The space object pointer further may be used to take azimuth and elevation readings, establish the oberver's zenith and horizon, and indicate the rise and set times of any object in space relative to an observer's horizon.

In addition, to provide a more compact instrument, a time equation graph inscribed on a sunbeam trace plate is divided into a northern hemisphere part and a southern hemisphere part, each part being aligned with a separate aperture of a sunbeam aperture plate.

Whereas the present invention has been described with respect to specific embodiments thereof, it will be understood that various changes and modifications, such as attaching a telescope to the space object pointer 17 or dividing the analemma inscribed on the sunbeam trace plate 15*d* into more than two parts, will be suggested to one skilled in the art. It is intended to encompass such changes and modifications to the extent they fall within the scope of the appended claims.

What is claimed is:

1. A space transit, comprising:

a. support means rotatable about both a vertical axis and a horizontal axis;

b. a rotary plate mounted on said support means so as to rotate about a principal axis perpendicular to the face of said plate and to said horizontal axis, said plate having three integral subplates upstanding perpendicular to said face, two of said subplates providing a space aperture and space trace combination and with an hour scale inscribed on said face indexed to a line parallel to the axis of said combination;

c. a meridian marker structure cooperating with said hour scale on said plate mounted on said support means to both rotate about said principal axis and to be locked against rotation independent of said plate;

d. a second marker means rotatably mounted on the third of said subplates so as to rotate about an axis normal to said principal axis; and e. a space object pointer attached to said second marker means and positioned on a side of said third subplate opposite to said second marker means.

2. The combination set forth in claim 1 wherein said rotary plate has concentric scales inscribed thereon and centered about said principal axis and including a month-day scale, a right ascension hour angle scale, a local hour angle scale, a moon phase scale, a lunation interval scale, and a zodiac constellation display all cooperating with said meridian marker structure.

3. The combination set forth in claim 2 wherein said meridian marker includes a lunation blade pivotable about an axis spaced from but parallel to said principal axis of rotation for tracing moon phases on said lunation scale from a year of observation to a succeeding year.

4. The combination set forth in claim 3 wherein said meridian marker has one edge extending radially from said principal axis, and a tip bent to make sliding contact outside said hour scale.

5. The combination set forth in claim 4 wherein said space object pointer includes a sunbeam aperture shelf and a sunbeam trace shelf for tracking the sun.

6. The combination set forth in claim 1 wherein said third subplate has inscribed thereon a declination angle scale, wherein a second of said three subplates has inscribed thereon a mean sun base line, an analemma segmented in months, and wherein the first of said three subplates is apertured and parallel to said second of said subplates.

7. The combination set forth in claim 6 wherein said mean base line, said analemma, and said second declination angle scale are divided into two parts corresponding to the northern and southern celestial hemispheres.

8. The combination set forth in claim 1 wherein said space object pointer is a hollow sleeve having a 360° bubble level mounted on an exterior surface thereof with the axis thereof parallel to the axis of said sleeve.

9. A space object position and time of day indicator having a sunbeam aperture plate, and a sunbeam trace plate with a time equation graph inscribed thereon, the combination which comprises:

a. a main plate integral with said trace plate and aperture plate mounted for rotation relative to both a vertical axis, a horizontal axis, and a principal axis of rotation perpendicular to said main plate and to said horizontal axis, said main plate having inscribed on a circle there a time of day indicia indexed to a reference line parallel to a line extending through an aperture on said aperture plate and the base line of said graph;

b. a meridian marker mounted for rotation about said principal axis and lockable at any angle independent of said main plate;

c. space object pointer means supported by said main plate and rotatable about an axis perpendicular to said principal axis and to said reference line, level indicating means on said pointer parallel to the axis of said pointer means, an indicator rotatable with said pointer, and a scale element supported by said plate registrable with said indicating means.

10. The combination set forth in claim 9 wherein said pointer includes a sunbeam aperture shelf and a sunbeam trace shelf.

11. The combination set forth in claim 9 wherein said level indicating means is a bubble level internally ground to a barrel shape to accommodate 360° rotation.

12. A space transit comprising:

a. a support means rotatable about both a vertical axis and a horizontal axis, b. a rotary plate mounted on said support for rotation about a principal axis normal to said horizontal axis, said plate having an hour scale thereon indexed to a center line passing through the center of rotation of said plate, with three integral subplates normal to the face of said plate, two of said plates being parallel to each other and spaced apart with one of the two plates having an analemma thereon and the other apertured on a second line parallel to said center line with said second line passing through the base line of said analemma, the third plate being perpendicular to said two subplates and having a declination scale thereon with the zeroes thereof on a line parallel to the plane of said rotary plate, c. meridian marker adjustably mounted for rotation on the axis of rotation of said rotary plate and having means adapted to lock the same relative to said support means while permitting rotation of said rotary plate relative thereto, d. a second marker rotatably mounted on said third plate to rotate about an axis normal to said principal axis, and e. a space object pointer attached to rotate with said second marker and positioned on the side of said third plate opposite said second marker.

* * * * *